US006494591B1

(12) United States Patent
Guimond

(10) Patent No.: US 6,494,591 B1
(45) Date of Patent: Dec. 17, 2002

(54) ORNAMENTAL LIGHTING DEVICE

(76) Inventor: Gail E. Guimond, 5020 N. Langham Ave., Covina, CA (US) 91724

( * ) Notice: Subject to any disclaimer, the term of this patent is extended or adjusted under 35 U.S.C. 154(b) by 0 days.

(21) Appl. No.: 09/574,529

(22) Filed: May 19, 2000

(51) Int. Cl.[7] ..... F21V 21/00
(52) U.S. Cl. ..... 362/249; 362/145; 362/806
(58) Field of Search ..... 362/145, 152, 362/235, 237, 240, 246, 226, 249, 252, 806, 808, 382, 432, 404, 391; 439/110, 112, 116, 117

(56) References Cited

U.S. PATENT DOCUMENTS

| | | | | | |
|---|---|---|---|---|---|
| 2,042,905 | A | | 6/1936 | McCluskey | |
| 2,714,652 | A | * | 8/1955 | Meyer | 362/249 |
| 2,815,439 | A | * | 12/1957 | Plubell | 362/806 |
| 3,302,013 | A | | 1/1967 | Richardson | |
| 3,704,365 | A | | 11/1972 | Miller | |
| 5,124,903 | A | * | 6/1992 | Coviello | 362/249 |
| 5,341,276 | A | * | 8/1994 | Shen | 362/404 |
| 5,359,506 | A | * | 10/1994 | Koleno | 362/806 |
| 5,653,530 | A | | 8/1997 | Pittman | |
| D383,226 | S | | 9/1997 | Odierna | |
| D400,272 | S | | 10/1998 | Mount | |
| 5,918,967 | A | * | 7/1999 | Land | 362/255 |

* cited by examiner

*Primary Examiner*—Y. My Quach-Lee

(57) ABSTRACT

A ornamental lighting device for interchanging light covers for respective holidays. The ornamental lighting device includes a plurality of light sockets. Each of the light sockets is operationally coupled to a power cord. A plurality of light bulbs is each removably coupled to one of the light sockets. Each of a plurality of light coverings comprises a substantially hollow housing having an opening therein for receiving one of the light bulbs. Each of the light coverings is removably couplable to one of the light sockets. Each of the light coverings comprises a generally translucent material. The light coverings each have a shape resembling a holiday symbol.

9 Claims, 4 Drawing Sheets

ORNAMENTAL LIGHTING DEVICE

BACKGROUND OF THE INVENTION

1. Field of the Invention

The present invention relates to lighting devices and more particularly pertains to a new ornamental lighting device for interchanging light covers for respective holidays.

2. Description of the Prior Art

The use of lighting devices is known in the prior art. More specifically, lighting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,704,365; U.S. Pat. No. 2,042,905; U.S. Des. Pat. No. 400,272; U.S. Pat. No. 3,302,013; U.S. Pat. No. 5,653,530; and U.S. Des. Pat. No. 383,226.

While these devices fulfill their respective, particular objectives and requirements, the aforementioned patents do not disclose a new ornamental lighting device. The inventive device includes a plurality of light sockets. Each of the light sockets is operationally coupled to a power cord. A plurality of light bulbs is each removably coupled to one of the light sockets. Each of a plurality of light coverings comprises a substantially hollow housing having an opening therein for receiving one of the light bulbs. Each of the light coverings is removably couplable to one of the light sockets. Each of the light coverings comprises a generally translucent material. The light coverings each have a shape resembling a holiday symbol.

In these respects, the ornamental lighting device according to the present invention substantially departs from the conventional concepts and designs of the prior art, and in so doing provides an apparatus primarily developed for the purpose of interchanging light covers for respective holidays.

SUMMARY OF THE INVENTION

In view of the foregoing disadvantages inherent in the known types of lighting devices now present in the prior art, the present invention provides a new ornamental lighting device construction wherein the same can be utilized for interchanging light covers for respective holidays.

The general purpose of the present invention, which will be described subsequently in greater detail, is to provide a new ornamental lighting device apparatus and method which has many of the advantages of the lighting devices mentioned heretofore and many novel features that result in a new ornamental lighting device which is not anticipated, render-ed obvious, suggested, or even implied by any of the prior art lighting devices, either alone or in any combination thereof.

To attain this, the present invention generally comprises a plurality of light sockets. Each of the light sockets is operationally coupled to a power cord. Each of a plurality of light bulbs is removably coupled to one of the light sockets. Each of a plurality of light coverings comprises a substantially hollow housing having an opening therein for receiving one of the light bulbs. Each of the light coverings is removably couplable to one of the light sockets. Each of the light coverings comprises a generally translucent material. The light coverings each have a shape resembling a holiday symbol.

There has thus been Outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining g at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to he understood that the phraseology and terminology employed herein are for the purpose of description and should not be regarded as limiting As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including s Such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ornamental lighting device apparatus and method which has many of the advantages of the lighting devices mentioned heretofore and many novel features that result in a new ornamental lighting device which is not anticipated, rendered obvious, suggested, or even implied by any of the prior art lighting devices, either alone or in any combination thereof.

It is another object of the present invention to provide a new ornamental lighting device which may be easily and efficiently manufactured and marketed.

It is a further object of the present invention to provide a new ornamental lighting device which is of a durable and reliable construction.

An even further object of the present invention is to provide a new ornamental lighting device which is susceptible of a low cost of manufacture with regard to both materials and labor, and which accordingly is then susceptible of low prices of sale to the consuming public, thereby making such ornamental lighting device economically available to the buying public.

Still yet another object of the present invention is to provide a new ornamental lighting device which provides in the apparatuses and methods of the prior art some of the advantages thereof, while simultaneously overcoming some of the disadvantages normally associated therewith.

Still another object of the present invention is to provide a new ornamental lighting device for interchanging light covers for respective holidays.

Yet another object of the present invention is to provide a new ornamental lighting device which includes a plurality of light sockets. Each of the light sockets is operationally coupled to a power cord. Each of a plurality of light bulbs is removably coupled to one of the light sockets. Each of a plurality of light coverings comprises a substantially hollow housing having an opening therein for receiving one of the light bulbs. Each of the light coverings is removably couplable to one of the light sockets. Each of the light coverings comprises a generally translucent material. The light coverings each have a shape resembling a holiday symbol.

Still yet another object of the present invention is to provide a new ornamental lighting device that allows the user to leave the strand of lights up year around and change the light coverings such that they represent the current holiday being celebrated.

These together with other objects of the invention, along with the various features of novelty which characterize the invention, are pointed out with particularity in the claims annexed to and forming a part of this disclosure. For a better understanding of the invention. Its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
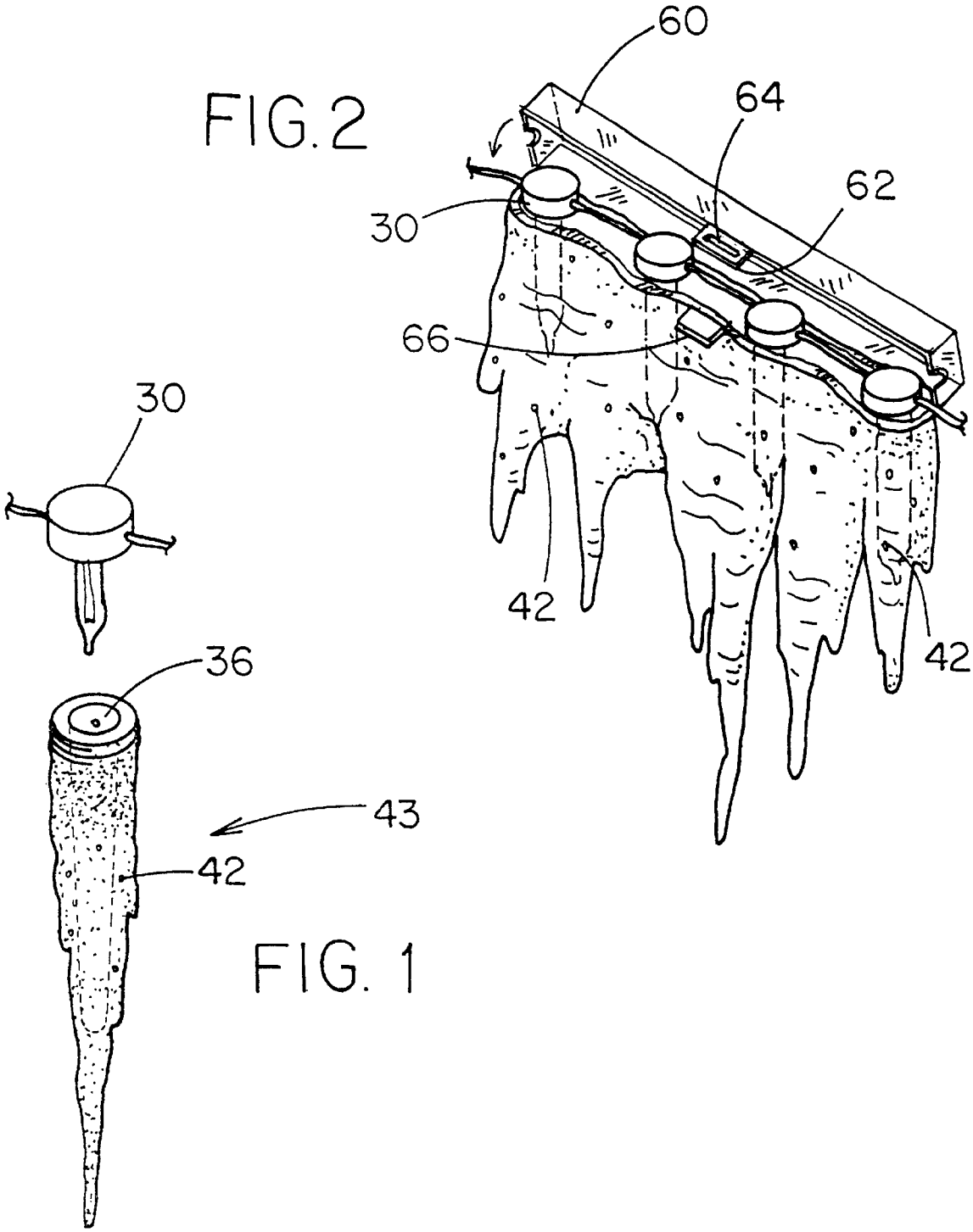
FIG. 1 is a schematic perspective view of a new ornamental sighting device according to the present invention.
FIG. 2 is a schematic perspective view of the present invention.
Figure 3:
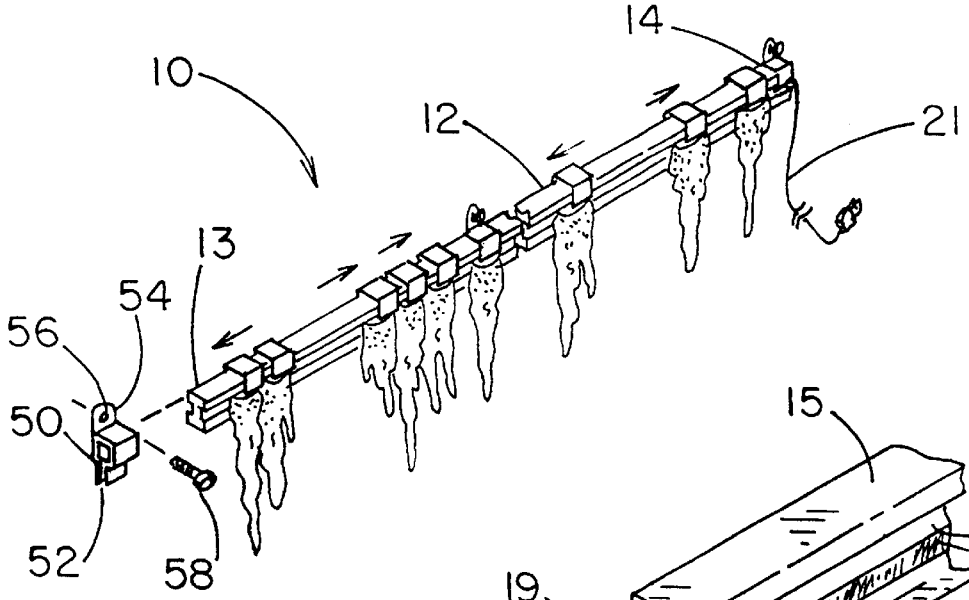
FIG. 3 is a schematic perspective view of the present invention.
Figure 4:
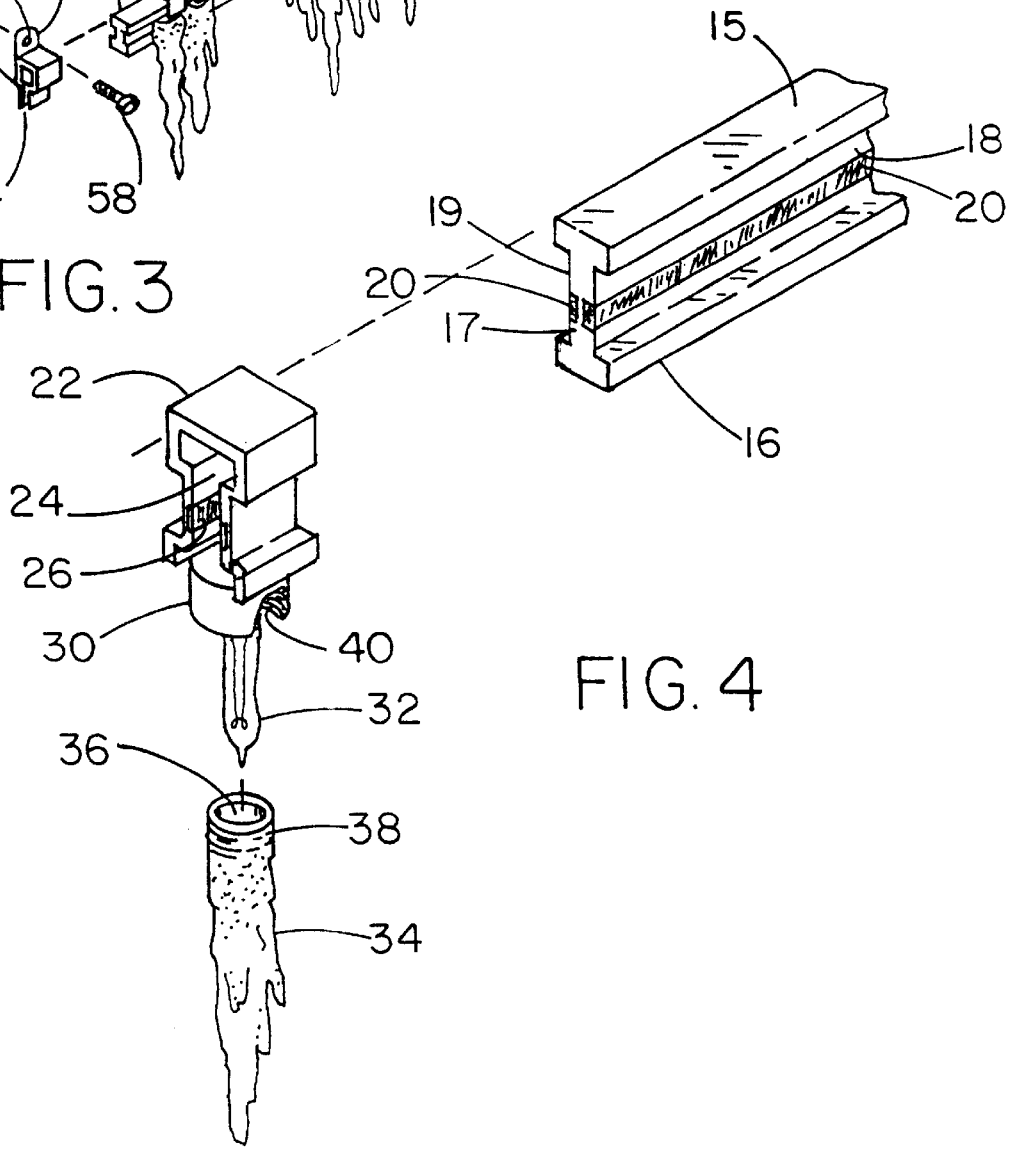
FIG. 4 is a schematic exploded perspective view of the support bar and Support block of the present invention.
Figure 5:
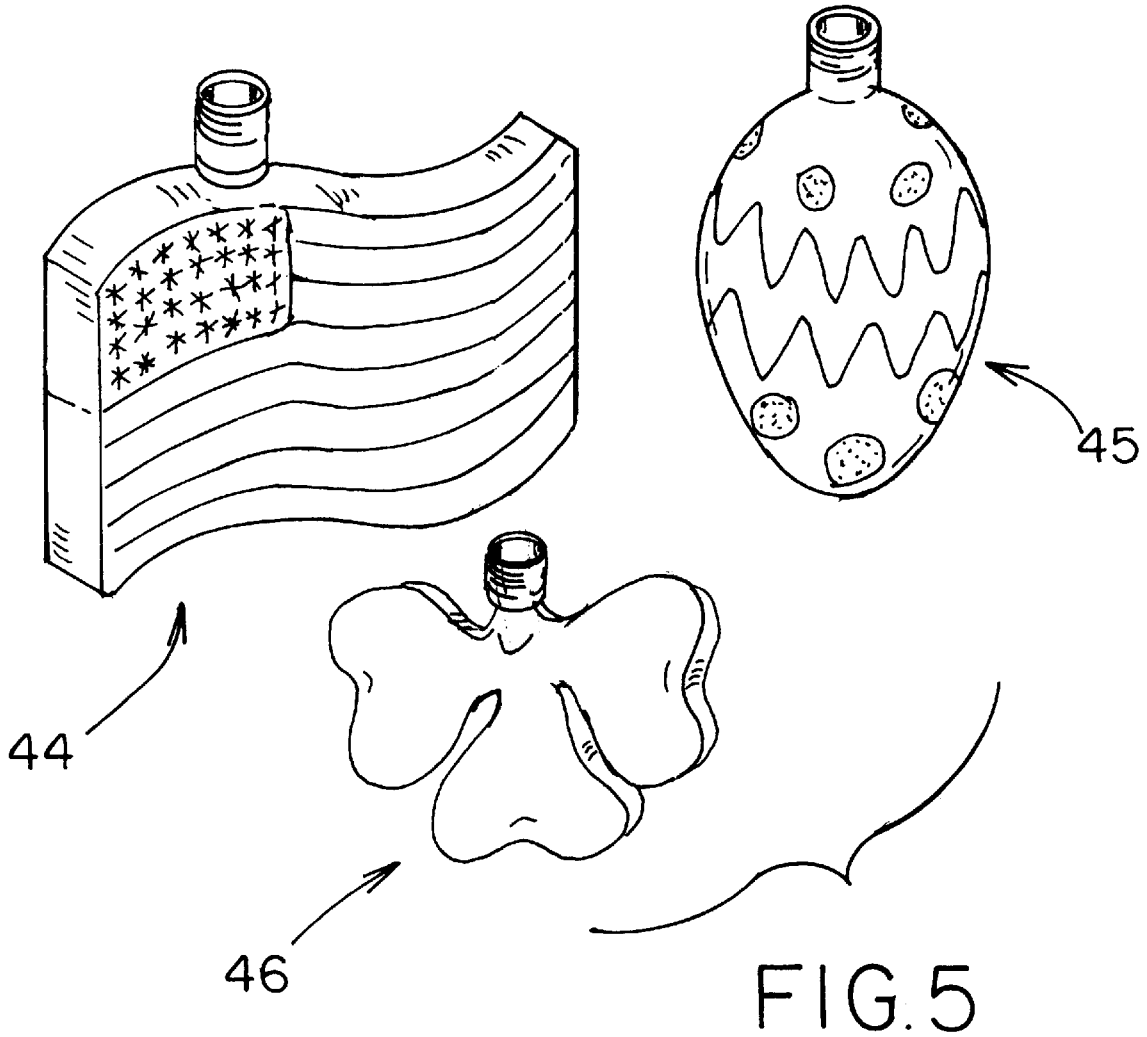
FIG. 5 is a schematic perspective view of light coverings of present invention.
Figure 6:
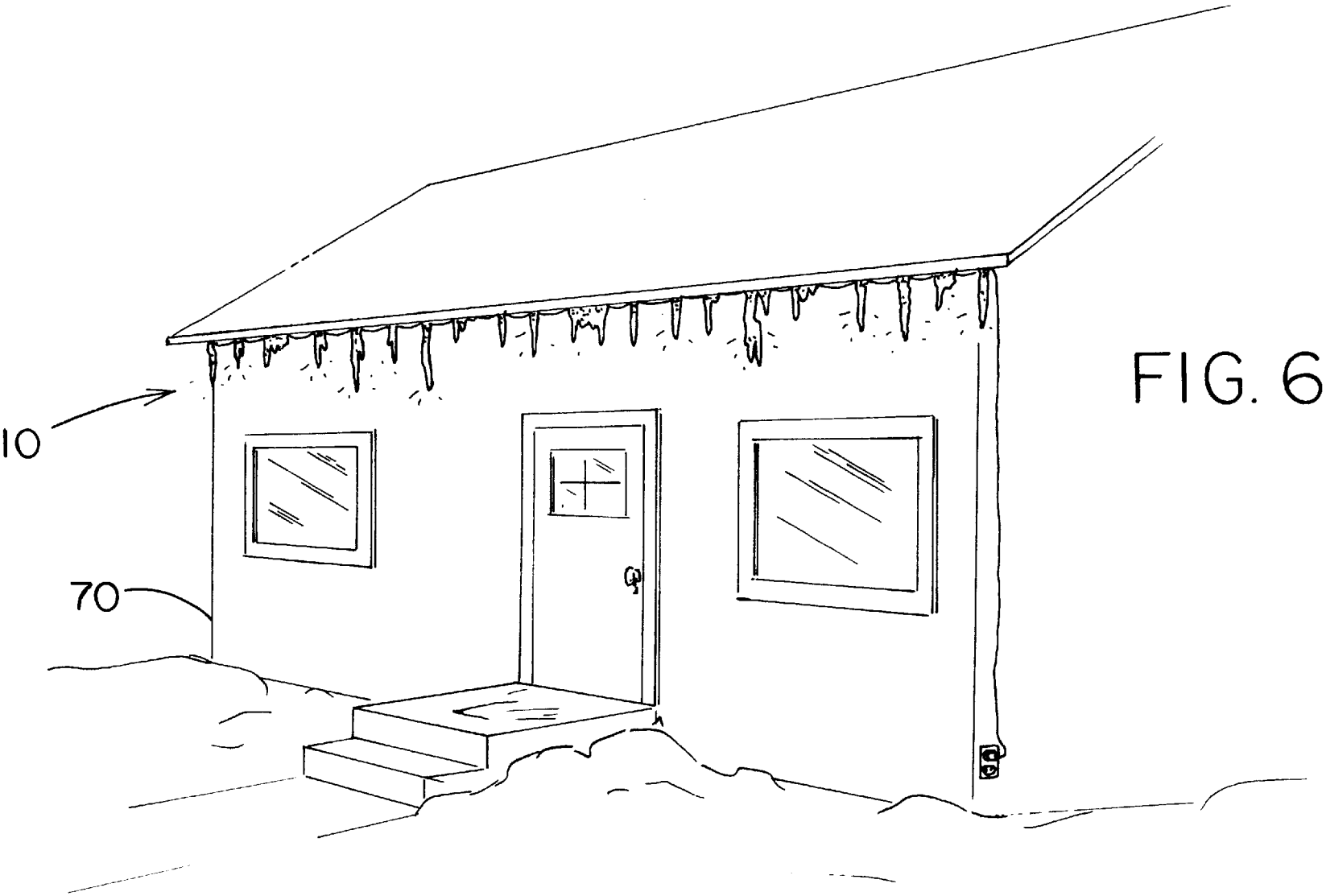
FIG. 6 is a schematic perspective view of the invention coupled to a dwelling.

With reference now to the drawings, and in particular to FIGS. 1 through 6 thereof, a new ornamental lighting device embodying the principles and concepts of the present invention and generally designated by the reference numeral 10 will be described.

As best illustrated in FIGS. 1 through 6, the ornamental lighting device 10 generally comprises a support bar 12. The support bar 12 is elongate. The support bar 12 has a first end 13 and a second end 14. The support bar 14 has a top side 15, a bottom side 16 and a middle section 17. The middle section 17 has a front side 18 and a back side 19 The front 18 and back 19 sides of the middle section 17 have surfaces each having an electrical contact strip 20 integrally coupled thereto. The support bar 12 has a generally I-shaped cross-section taken transverse to a longitudinal axis of the support bar 12. The contact strips 20 are operationally coupled to a power cord 21.

A plurality of support blocks 22 is each adapted for supporting a light socket 30 on the support bar 12. Each of the support blocks 22 has a slot 24 extending therethrough. Each of the slots 24 has a shape substantially identical to a cross-section of the Support bar 12. Each of the support blocks 22 is slidably mountable on the Support bar 12. The slots 24 have an inner surface having a pails of opposed electrical contacts 26 thereon. The electrical contacts 26 are abutted against the electrical strips 20 when the support blocks 22 are mounted on the support bar 12.

Each of a plurality of light sockets 30 is preferably fixedly mounted to one of the support blocks 22. Each of the light sockets 30 is operationally coupled to the electrical contacts 26.

Each of a plurality of light bulbs 32 each is removably coupled to one of the light sockets 30.

A plurality of light coverings 34 is illuminated by the light bulbs 32. Each of the light coverings 34 comprises a substantially hollow housing having an opening 36 therein for receiving one of the light bulbs 32. Each of the openings 36 is removably couplable to one of the light sockets 30. FIG. 1 shows the light covering having a threaded peripheral wall 38 which may be screwed into a peripheral wall 40 around the light socket 30, though other conventional coupling means may be utilized. The light coverings 34 each have a plurality of apertures 42 therein for allowing airflow to avoid overheating of the light bulb 32. Each of the light coverings 34 comprises a generally translucent material. The translucent material comprising a plastic. Preferably, a portion of the light coverings 34 resembles icicles 43, a portion of the light covering resembling U.S. flags 44, a portion of the light coverings resembling easter eggs 45, and a portion of the light coverings resembling clovers 46. The light coverings 34 may also resemble halloween associated objects or any other celebration or holiday symbols.

A coupling means couples the support bar to the dwelling. The coupling means comprises a pair of brackets 50. Each of the brackets 50 has a slot 52 therein adapted for slidably receiving the support bar 12. Each of the brackets 50 has a top wall having a flange 54 thereon. Each of the flanges 54 has a bore 56 therethrough for receiving, a fastening means 58. The fastening means 58 preferably comprises a screw though any conventional fastening means may be used.

FIGS. 1 and 2 depict an embodiment where the support bar 12 and the support blocks 22 are not used. In this embodiment, the light socket 30 is directly coupled to the power cord 21. The opening 36 in the light covering 34 may be one of a plurality of openings in the light covering. Each of the openings lie substantially in a plane and are generally aligned. A cover portion 60 is hingedly coupled to an edge of the light covering 34. The cover portion 60 is adapted for covering the openings in the light covering. The cover portion 60 has a lip 62 thereon adapted to selectively lock to the light covering 34 to define a closed position. Lip has a slit 64 therein for receiving a tab 66 extending from the light covering 34. Each of the sockets 30 is positioned such that each of the light bulbs 32 extends through one of the openings in the light covering 34. The light sockets 30 and the light bulbs 32 are generally immobile when the cover portion 60 is in the closed position.

The user of the device 10 may change the light coverings 34 in order to coordinate the seasons and holidays without having to remove the entire strand of lights from a dwelling 70. The light covering 34 itself is removed to be replaced with one that is associated with the upcoming holiday, celebration or festival.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and chances will readily occur to those skilled in the art, it is not desired to limit the invention to the exact construction and operation shown and described, and accordingly, all suitable modifications and equivalents may be resorted to, falling within the scope of the invention.

I claim:

1. An ornamental lighting device, said device being removably attachable to a dwelling, said device comprising:

a plurality of light sockets, each of said light sockets being operationally coupled to a power cord;

a plurality of light bulbs, each of said light bulbs being removably coupled to one of said light sockets; and a plurality of light coverings, each of said light coverings comprising a substantially hollow housing having an opening therein for receiving one of said light bulbs, each of said openings being removably mounted to one of said light sockets, each of said light coverings comprising a substantially translucent material, each of said light coverings having a shape resembling a holiday symbol;

an elongate support bar having a first end and a second end, said support bar having a top side, a bottom side and a middle section said middle section having a front side and a back side, said front and back sides of said middle section having surfaces, each of said front and back sides of said middle section having an electrical contact strip integrally coupled thereto, said contact strips being operationally coupled to said power cord;

a plurality of support blocks, each of said support blocks being adapted for supporting one of said light sockets on said support bar, each of said support blocks having a slot extending therethrough, each of said slots having a shape substantially identical to a cross-section of said support bar, each of said support blocks being slidably mounted on said support bar, each of said slots having an inner surface having a pair of opposed electrical contacts thereon, wherein said electrical contacts are abutted against said electrical contact strips when said support blocks are mounted on said support bar; and wherein each of said light sockets are operationally coupled to said electrical contacts.

2. The ornamental lighting device as in claim 1, wherein said light coverings further comprise:

a portion of the plurality of said light coverings each having a shape resembling an icicle, a portion of the plurality of said light coverings each having a shape resembling a U.S. flag, a portion of the plurality of said light coverings each having a shape resembling an easter egg, a portion of the plurality of said light coverings each having a shape resembling a clover.

3. The ornamental lighting device as in claim 1, further comprising a coupling means for coupling said support bar to said dwelling, said coupling means comprising a pair of brackets, each of said brackets having a slot therein adapted for slidably receiving said support bar, each of said brackets having a top wall having a flange thereon, each of said flanges having a bore therethrough for receiving a fastening means.

4. The ornamental lighting device as in claim 1, wherein a portion of the plurality of said light coverings each has a shape resembling an icicle.

5. The ornamental lighting device as in claim 1, wherein a portion of the plurality of said light coverings each has a shape resembling a U.S. flag.

6. The ornamental lighting device as in claim 1, wherein a portion of the plurality of said light coverings each has a shape resembling an easter egg.

7. The ornamental lighting device as in claim 1, wherein a portion of the plurality of said light coverings each has a shape resembling a clover.

8. An ornamental lighting device, said device being removably attachable to a dwelling, said device comprising:

a support bar, said support bar being elongate, said support bar having a first end and a second end, said support bar having a top side, a bottom side and a middle section, said middle section having a front side and a back side, said front and back sides of said middle section having surfaces, each of said front and back sides of said middle section having an electrical contact strip integrally coupled thereto, said support bar having a generally I-shaped cross-section taken transverse to a longitudinal axis of said support bar, said contact strips being operationally coupled to a power cord;

a plurality of support blocks, each of said support blocks being adapted for supporting a light socket on said support bar, each of said support blocks having a slot extending therethrough, each of said slots having a shape substantially identical to a cross-section of said support bar, each of said support blocks being slidably mounted on said support bar, each of said slots having an inner surface having a pair of opposed electrical contacts thereon, wherein said electrical contacts are abutted against said electrical contact strips when said support blocks are mounted on said support bar;

a plurality of light sockets, each of said light sockets being fixedly mounted to one of said support blocks, each of said light sockets being operationally coupled to said electrical contacts;

a plurality of light bulbs, each of said light bulbs being removably coupled to one of said light sockets;

a plurality of light coverings, each of said light coverings comprising a substantially hollow housing having an opening therein for receiving one of said light bulbs, each of said openings being removably mounted to one of said light sockets, each of said light coverings having a plurality of apertures therein, each of said light coverings comprising a substantially translucent material, said translucent material comprising a plastic, a portion of the plurality of said light coverings each having a shape resembling an icicle, a portion of the plurality of said light coverings each having a shape resembling a U.S. flag, a portion of the plurality of said light coverings each having a shape resembling an easter egg, a portion of the plurality of said light coverings each having a shape resembling a clover; and a coupling means for coupling said support bar to said dwelling, said coupling means comprising a pair of brackets, each of said brackets having a slot therein adapted for slidably receiving said support bar, each of said brackets having a top wall having a flange thereon, each of said flanges having a bore therethrough for receiving a fastening means, said fastening means comprising a screw.

9. An ornamental lighting device comprising:

a plurality of light sockets, each of said light sockets being operationally coupled to a power cord;

a plurality of light bulbs, each of said light bulbs being removably coupled to one of said light sockets; and a light covering comprising a substantially hollow housing having a plurality of openings, each of said plurality of openings removably receiving one of said light bulbs and being removably mounted to one of said light sockets, said light covering comprising a substantially translucent material;

wherein said plurality of said openings lie substantially in a plane and are substantially aligned, a cover portion being hingedly coupled to an edge of said light covering, said cover portion being adapted for covering said openings in said light covering, said cover portion having a lip thereon adapted to selectively lock to said light covering to define a closed position;

each of said sockets being positioned such that each of said light bulbs extends through one of said openings and said light covering, wherein said light sockets and said light bulbs are fixed in position to said light covering when said cover portion is in said closed position; and said light covering having a shape covering resembling a plurality of icicles.

* * * * *